US006688376B2

(12) United States Patent
Koenig

(10) Patent No.: US 6,688,376 B2
(45) **Date of Patent: *Feb. 10, 2004**

(54) TWO PORT COIL CAPACITY MODULATOR

(76) Inventor: Robert Peter Koenig, 1720 W. 115 Cir., Westminster, CO (US) 80234

( * ) Notice: Subject to any disclaimer, the term of this patent is extended or adjusted under 35 U.S.C. 154(b) by 0 days.

This patent is subject to a terminal disclaimer.

(21) Appl. No.: 09/983,060

(22) Filed: Oct. 23, 2001

(65) Prior Publication Data

US 2003/0075303 A1 Apr. 24, 2003

(51) Int. Cl.[7] ..... F25B 29/00

(52) U.S. Cl. ..... 165/48.1; 165/50; 165/96; 165/101; 165/103

(58) Field of Search ..... 165/48.1, 50, 96, 165/101, 103

(56) References Cited

U.S. PATENT DOCUMENTS

| | | | | | |
|---|---|---|---|---|---|
| 386,556 | A | * | 7/1888 | Prall | 237/70 |
| 614,658 | A | * | 11/1898 | Leitch | 237/70 |
| 839,561 | A | * | 12/1906 | Davis | 165/96 |
| 869,042 | A | * | 10/1907 | Andrews | 165/96 |
| 1,799,107 | A | * | 3/1931 | Lobelle | 165/101 |
| 1,830,719 | A | * | 11/1931 | Rollins | 165/101 |
| 2,261,596 | A | * | 11/1941 | Stroobants | 165/96 |
| 3,195,622 | A | * | 7/1965 | Haufler et al. | 165/101 |
| 3,211,375 | A | * | 10/1965 | Prokupek et al. | 165/103 |

FOREIGN PATENT DOCUMENTS

| | | | | |
|---|---|---|---|---|
| AT | 103096 | * | 6/1924 | 165/101 |
| CH | 40657 | * | 8/1966 | 237/59 |
| DE | 214188 | * | 10/1909 | 165/101 |
| DE | 486098 | * | 11/1929 | 165/101 |
| DE | 615237 | * | 6/1935 | 237/70 |
| DK | 50503 | * | 1/1935 | 165/101 |
| GB | 103351 | * | 4/1917 | 165/101 |
| GB | 306010 | * | 2/1929 | 165/101 |
| GB | 686064 | * | 1/1953 | 165/103 |
| GB | 1052095 | * | 12/1966 | 237/59 |
| NO | 61325 | * | 8/1939 | 165/101 |

* cited by examiner

*Primary Examiner*—John K. Ford
(74) *Attorney, Agent, or Firm*—John P. Halvonik

(57) ABSTRACT

A coil modulator apparatus for use in connection with heat transfer coil assemblies found in commercial heating and air conditioning units is used to limit the number of active tube sections in cooling coil assemblies. The two port modulator apparatus comprises an inner valve, having valve ports in the sides of the valve, that rotates within an outer housing having openings that correspond to those ports in the inner valve. Apertures in the outer housing connect with upstream and downstream tube sections in the bank of tubes. As the actuator arm of the coil assembly is rotated this rotates one of the valves changing the orientation of the outer and inner valve ports and so cutting off water flow in various tubes depending upon how far the actuator is moved.

3 Claims, 3 Drawing Sheets

TWO PORT COIL CAPACITY MODULATOR

FIELD OF THE INVENTION

The invention relates to the field of heating and cooling units and an improved modulator for use in re-directing the flow of liquid it the coil bank assembly. It is thought that the primary use of the invention would be in connection with cooling units since the primary purpose of the invention is to vary the number of active tubes, both upstream and downstream in a bank of tubes.

A coil assembly is really a bank of tubes, with each tube known as a "tube row" or may be referred to as simply a "tube" in this application. There are both upstream and downstream section to each tube in the coil. Upstream sections (see 15 in FIG. 4) are those sections of the tube that carry the flow of water (or other fluid) from that end of the coil from where the supply manifold (see 1 in FIG. 4) is and then to the opposite end of the bank. Downstream sections are those sections that carry the flow back, i.e. from the opposite end of the bank back to the return manifold at the other end of the bank.

There are several ways in which these types of coils are used in the industry. For heating only; utilizing hot water, for cooling only; utilizing chilled water and for heating and cooling in what is called a change over system where the heating and cooling medium is changed depending on the needs. The modulator described herein is primarily intended to be used for the cooling application which means air conditioning units, primarily.

The inner and an outer valve together form the modulator section (which may be placed at 3, 4 or 5 in FIG. 4) of the present invention that is connected at one end of the tube bank or coil. Various tube sections of the coil are then in connection with ports on the outer valve. Ports on the inner valve correspond to those on the outer valve so water will flow into and out of the modulator and back through a downstream section of the tube bank.

The rotation of the inner valve varies with respect to the outer valve and this will limit the number of active upstream tube sections in a bank of cooling tubes and that in turn will allow the full travel length of the remaining tube sections to be used by the water flowing through the unit.

BACKGROUND AND PRIOR ART OF THE INVENTION

There is not believed to be any prior art systems that use a two port modulator with a varying individual tube flow control. Flow control is achieved by rotation of an inner and an outer valve that form the modulator and the alignment of apertures in each will control the flow of water through various tubes in the bank thus providing a novel system that will vary the travel path of the water in the coil in order to provide maximum heat transfer and a longer circuit path even when there may be less volume of water working in the coil.

The system is believed to find its greatest use in commercial building types of applications where large air conditioning units are used to cool buildings. The design of most such heating/ac units results in a bank of heat transfer tubes that is fed by an inlet manifold. The flow of water through the modulator will vary in response to a control device that in turn varies the number of active tubes so that the same volume of water can travel a longer circuit in the bank and thereby transfer more heat during its passage through the bank. This means that the water in the return line will run at a higher temperature and the chiller will operate more efficiently.

The present invention is believed to be useful as the use of the modulator will increase amount of heat transfer for a given volume of water.

Stratification of air within the bank will be reduced as will and this will result in improved performance of the unit as well. The unit is also believed to improve upon the design efficiency of existing units as the temperature differential between the upstream and downstream tube sections is more controllable.

SUMMARY OF THE INVENTION

An improved heat transfer coil assembly for chilled water units whereby a coil modulator is used in connection with the heat transfer coil assembly. The two port modulator is used to vary the number of active tube sections in cooling coil assemblies. The modulator comprises an inner valve, having valve ports in the sides of the valve, that rotates within an outer housing having openings that correspond to those ports in the inner valve. Apertures in the outer housing connect with upstream and downstream tube sections in the bank of tubes. As the actuator arm of the modulator is moved in response to changes in the temperature of the operating unit and/or the building to thereby control the flow of water through the unit. The actuator arms rotates the inner valve changing the orientation of the outer and inner valve ports and so as the actuator arm is moved further, this will vary water flow to more tubes in the bank.

It is an object of the invention to provide for improved heat transfer in a coil assembly heat transfer unit by passing water through more tubing under part load conditions of the system by altering the circuit (i.e. the flow path of the liquid) of the coil.

Another object of the invention is to increase the amount of heat transfer for a given volume of water in a heat transfer system by causing the water to travel further thus increasing the amount of heat transfer and raising the temperature of the water in the return line.

Another object is to improve efficiency in chiller systems by creating a greater heat transfer in a given volume of liquid to thereby improve the operating efficiency of chiller units.

Another object is to provide uniform distribution of liquid through coil banks of two or more coils in parallel thereby eliminating the need for circulator pumps to serve that purpose.

Another object is to minimize energy consumption through the elimination of those tertiary pumps used in conjunction with prior art coil arrangements in order to provide uniform distribution through the tube banks.

Other objects of the invention will become apparent to those skilled in the art once the invention has been shown and described.

DESCRIPTION OF THE PREFERRED EMBODIMENT

Figure 1:
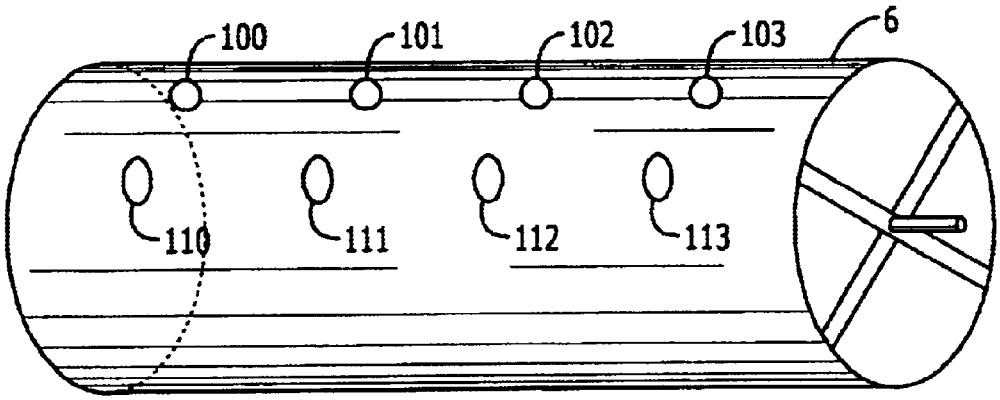
FIG. 1 Inner valve construction.
Figure 2:
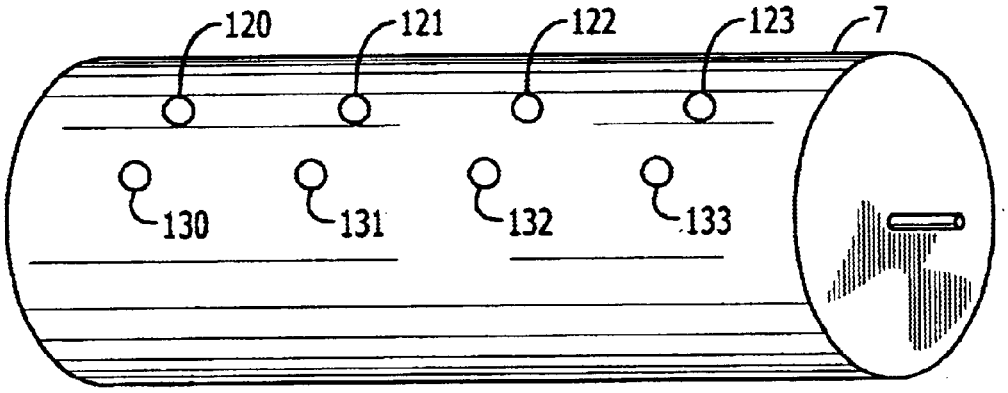
FIG. 2 Outer valve body.

The invention is a two port modulator for use in connection with tube rows found in cooling units. See FIGS. 1–3. Typically these cooling units would be air conditioning units found in commercial installations like office buildings. The modulator is essentially a valve that regulates the flow of liquid, such as water, going through the bank of tubes. The two port modulator allows the number of active tubes in the bank of tubes to be varied according to system requirements. The modulator could be used in connection with a sensor that detects when the flow demands on the system have diminished and so that it can in turn, diminish the flow through the bank by rotating the valve of the modulator.

The porting of the inlet and outlet ports on the modulator valve is arranged so that the number of active upstream and downstream tubes in the bank can be varied. This can be by means of an actuator arm 14 e.g. the one shown in FIG. 3. Note that port 10 is upstream and port 11 is downstream in FIG. 3. Connection 8 is in connection with upstream tube sections and connection 9 is in connection with downstream tube sections, see FIGS. 3 and 4.

The actuator can be controlled on a modulating or pulsed basis with periodic movements of the arm designed to vary the volume flow of liquid in the bank in response to changing temperature conditions. A temperature controller may be used in connection with the arm. The controller would sense changes in the temperature and then send a signal to the inner valve actuator to vary the volume of liquid flow in response.

The modulator described herein would be a two port modulator There is no need for a third port, which in other alternate systems may use a third line (and hence a third port) i.e. a bypass return line in connection with the modulator. In the apparatus described here there is no need to insure a high flow rate through a row of tubes and hence no need for a bypass line to prevent freezing of the tubes. Since the air entering the bank of cooling tubes will usually be above 32° F. there is little danger of freezing and hence insuring a high rate of flow, to prevent freezing of the tubes/lines, is not necessary.

The two port modulator that is the subject of the invention then, is likely to be used as an integral part of new coils or as a retrofitted apparatus that can be added to standard pre existing cooling coil assemblies. The coil assembly is shown as the bank of tube sections 15 in FIG. 4, with an means to direct an air flow 20 across the bank of tubes for a typical air conditioning unit.

The standard coil housing is essentially a plurality of serpentine tubes for transferring heat in a heating/ac system. The modulator is mainly comprised of an inner valve with apertures that rotates inside of a corresponding outer valve, see FIGS. 1 and 2. Depending on the particular application, the apertures in the outer and inner valves may be of the same size and shape or, alternately, as a tapered shape (a.k.a.: "characterized shape"). See 21 in FIG. 9.

When the apertures are in alignment, they will allow the flow of liquid through all the coil tubes in the bank. This is shown by the positions marked as "position 1" in FIG. 5. As the apertures in the inner valve are moved to the right out of alignment with the apertures in the outer valve the free area of the apertures is reduced thus resulting in flow being cut off in certain sections of the tube row. These position of the apertures on the inner valve are shown as "position 2" with position 3 being where three of the upstream tubes are cut off and the balance of tubes are modulating closed. Note: connection 8 is in connection with upstream tube sections and connection 9 is in connection with downstream tube sections.

Figure 3:
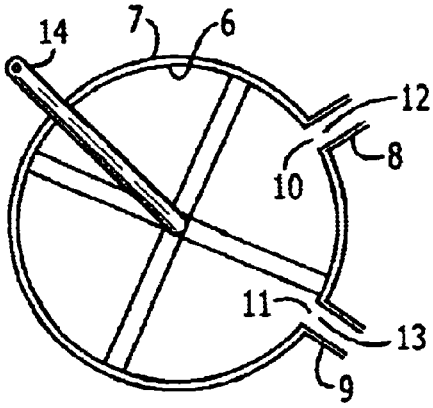
FIG. 3 Modulator assembly.

There is an inlet port 10 and outlet port 11 in connection with the modulator (see FIG. 3). Each of these inlet and outlet ports is in connection with a corresponding input manifold and return manifold. The manifolds are essentially in the same place as item 8 and 9 in FIG. 3. Essentially, the manifold is a collecting point for all the tubes in the bank and each manifold is in connection with a port 10 or 12 that is essentially an opening manufactured in the inner and outer valve respectively.

The inlet and outlet manifolds may be referred to as supply and return tubes. One inlet supply manifold feeds all the tubes in the bank. The outlet return manifold collects water from all the tubes in the bank.

An upstream section of a tube is merely a section where the water is flowing away from the end (of the bank of tubes) where the inlet manifold is and a downstream section is where water is flowing from the modulator and to the collection return manifold 2. Since the modulator may be placed in various alternative positions (alternate positions shown as 3, 4 or 5 in FIG. 4.) this will change which sections are downstream and which are upstream. For instance with the modulator in position 5 in FIG. 1 there is one upstream section (15) and three downstream sections. In position 4, there are three upstream sections and one downstream section.

The upstream section 15 (see FIG. 4) of a tube is connected to the supply tube or inlet manifold 1 and water flows throughout this section all the way to the end of the bank furthest from the supply tube where it makes a turn. The downstream section is for the return of the water in the coil back to the collection return manifold 2. The water in each tube reaches the end of the bank and returns through the bank via a downstream section of the tube. Water reaches that end (of the bank of tubes) where it started and exits the bank of tubes via the return manifold 2.

Figure 4:
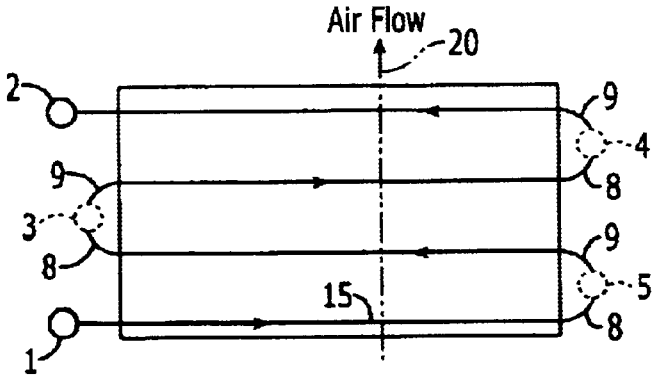
FIG. 4 plan view of one tube row four pass circuit (from supply to return)

To understand the connection between the modulator and the individual tubes in the bank, a closer look at a single tube in the bank is needed. In FIG. 4 can be seen the serpentine construction of single tube in the bank of tubes that comprise the coil assembly. The arrows within the assembly show direction of flow of water while the arrow at 20 show direction of air flow. This tube has 3 turns in it showing alternate locations for the modulator at 3, 4, and 5.

An upstream section is one of those like section 15 and a downstream section one of those exiting the modulator at 9. Numbers 3, 4, and 5 refer to optional design placements of the modulator. The position of the modulator in terms of where it is in relation to what section of the tubes, can vary depending on the application and has to be determined before the installation is completed. However many turns there are in a tube, the entrance and exit ports in the outer manifold of the modulator needs to be connected to an upstream and a downstream end respectively.

Figure 5:
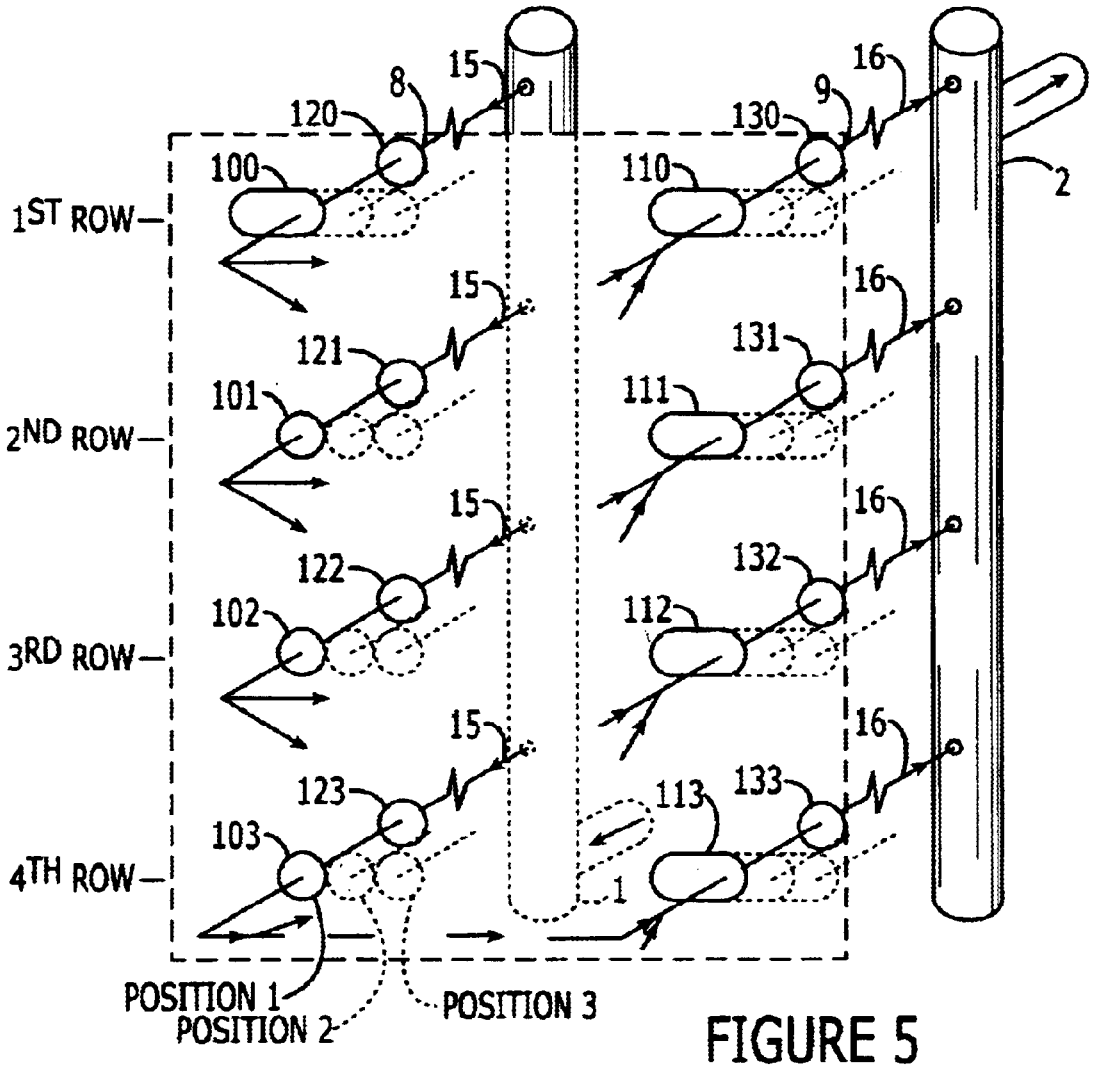
FIG. 5 Isometric view of modulator ports, coil tubes and supply and return manifold.

FIG. 5 shows a four row coil assembly in an isometric view. The relationship of those ports on the inner and outer valve of the modulator is shown here. The various rows of the tube bank are noted as "1st row" "2nd row" etc. The use of the ports will redirect the flow of water to only selected tubes but this will allow the tubes in use to utilize the full length of each tube so that maximum heat transfer can take place.

With the inner ports in position 1, the inner port valves 100, 101, 102 and 103 are aligned with the outer body ports 120, 121, 122, 123; and the inner valve outlet ports 110, 111, 112 and 113 are aligned with the outer body outlet ports 130, 131, 132, and 133. In the case where the ports are completely aligned with one another full flow will be permitted through all the tubes in the coil bank simultaneously.

Moving the ports horizontally as shown in FIG. 5, will cause certain of the apertures to close and thus completely cut off flow of water in these tubes. This is reflected at the bottom of FIG. 5 where "position 1" "position 2" etc. is indicated to show the various orientations of the ports as they are moved by the actuator. Hence port 100 has 3 locations in FIG. 5 to reflect these positions. Same for port 100, 101, etc port 111, 112, etc.

As shown by position 2 in the figure, apertures of ports 100/120 and 110/130 remains the full size of the opening, ports 101 and 102 and 103 are out of alignment with ports 121–123 and are therefore closed. Thus stopping flow through the upstream port of the tubes in the 2, 3rd and 4th row of the coil.

The volume of liquid entering the modulator from a single upstream tube through ports 100 and 120 is now diverted four ways leaving the modulator to the downstream tubes through ports 110–313 and 130–133 because ports 110–113 in the inner valve are elongated allowing the aperture to remain full size. As the inner valve modulates toward position 3 by action of actuator arm 14 in FIG. 3, the inlet ports 100 and 120 and outlet ports 110–113 and 130–133 modulate toward the closed position.

The modulator will thus reduce flow rate through the bank by cutting of some tubes and at the same time will increase the heat transfer surface of the bank in proportion to this reduction. This effect will be to create proportionately greater heat transfer surface which tends to increase the temperature differential between supply and return lines in chilled water systems (i.e. the difference between the water entering the coil at the supply manifold 1 and the temperature leaving the coil at the return manifold 2 as seen in FIG. 4). Thus resulting in increased chiller efficiency.

Figure 6:
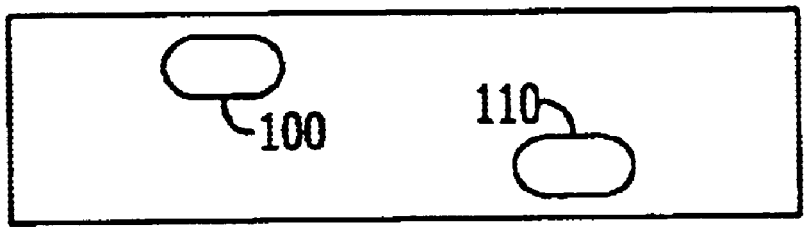
FIG. 6 Inner valve ports.
Figure 7:
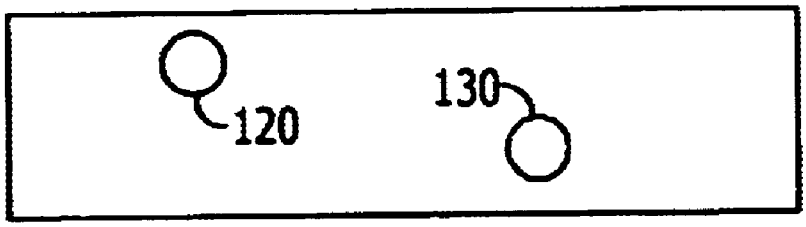
FIG. 7 outer valve ports.
Figure 8:
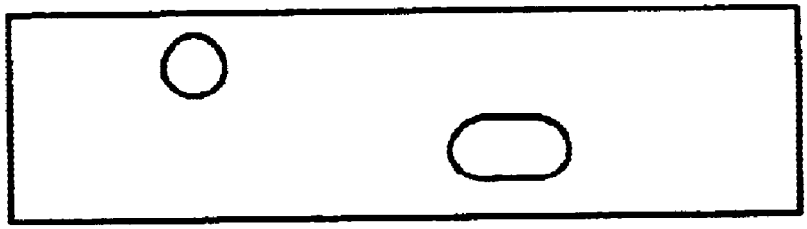
FIG. 8 Inner valve ports
Figure 9:
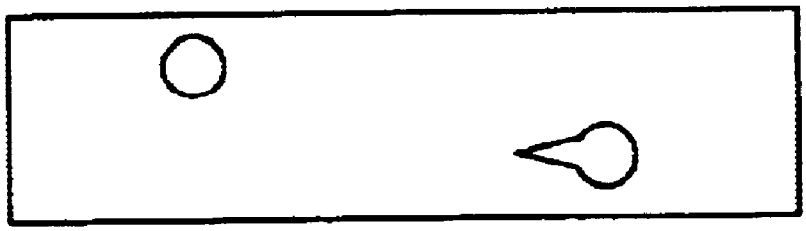
FIG. 9 Inner valve with one round and one characterized port per tube row.

FIG. 6 shows inner valve ports 100 and 110 elongated (or oval) as in FIG. 5 to allow port staging. FIG. 7 show outer valve ports 120 an 130 of circular shape which is the preferred shape for apertures in the outer valve. FIG. 8 shows different shaped ports 100 and 110 in the inner valve as in rows 2, 3 and 4 in FIG. 5. FIG. 9 shows one inner valve port round and one characterized in shape in order to produce unique flow characteristic for certain individual tubes in the bank.

Note that depending on the placement of the modulator (see FIG. 4) the number of upstream and down stream sections in a given tube row will vary.

Note that is possible that any single tube may have more than one downstream and return section within the bank, that is each tube may be of a serpentine construction so that the water flows to one end and back to the other end a number of times before it finally exits through the return tube. However the case may be, there will usually be an odd number of turns in the tube so that water will return back to the same end where it started.

The simplest tube in the bank would have one turn, and hence on upstream and one downstream section. A more tortuous tube might have three turns like that shown in FIG. 4, so that the water changes direction in the bank three times, with the last turn, returning back to the end it started from.

Note: There is one supply manifold 1 and one return manifold 2 that supplies the entire bank of tubes.

Note: The valve body may be split and held together by a bolt flange or may be of a tubular construction with a removable end cap for maintenance and servicing of the invention.

I claim:

1. A two port modulator connected to an intermediate portion of heat transfer coils that comprise a bank of tubes, said bank of tubes having an inlet header and outlet header for the flow of fluid through said bank, said two port modulator having an outer valve body having inlet ends and outlet ends connected to each of said tubes in said bank of tubes, each of said tubes having at least one upstream section where fluid flows away from said inlet header towards said inlet ends of said outer valve body, and at least one downstream section where fluid flows towards said outlet header from said outlet ends of said outer valve body, said outer valve body having an inner valve body disposed therein and each of said inner and outer valve bodies having a plurality of ports corresponding to each of said inlet ends and said outlet ends of said tubes, said ports arranged in pairs, each of said pairs comprising one of said inner valve ports and one of said outer valve ports, half of said ports comprising inlet ports and the other half of said ports comprising outlet ports, each of said inlet pairs being in connection with one of said upstream sections and each of said outlet pairs being in connection with a downstream section, said inner valve body having an actuator arm connected with said inner valve body and having means for rotating said inlet and outlet ports of said inner valve body in relation to said inlet and outlet ports of said outer valve body so as to vary the amount of fluid flow through said downstream sections of said tubes by varying the overlapping cross sections of said inlet and outlet ports of said inner and outer valve bodies.

2. The apparatus of claim 1 wherein certain of said inner valve ports have a characterized shape, said characterized shape comprising a tear drop shaped cross section.

3. The apparatus of claim 2 wherein each of said tubes in said bank of tubes has a plurality of upstream and downstream sections, each of said upstream and downstream sections being defined by each of said tubes having at least one sectional bend at the same point in every tube, said two port modulator being connected to each of said tube in said bank at one of said sectional bends.

* * * * *